United States Patent [19]

Stutz

[11] Patent Number: 4,512,028

[45] Date of Patent: Apr. 16, 1985

[54] ELECTRONIC SCANNER FOR MONITORING RUNNING THREADS AT A MULTITUDE OF LOCATIONS IN A TEXTILE MACHINE

[75] Inventor: Hansruedi Stutz, Dietlikon, Switzerland

[73] Assignee: Loepfe Brothers Limited, Wetziukon, Switzerland

[21] Appl. No.: 470,591

[22] Filed: Feb. 28, 1983

[30] Foreign Application Priority Data

Mar. 11, 1982 [CH] Switzerland ..... 1496/82

[51] Int. Cl.[3] ..... D01H 13/32; H03K 17/00; H03K 21/34

[52] U.S. Cl. ..... 377/16; 377/17; 377/56; 57/264; 57/265

[58] Field of Search ..... 377/15, 56, 16, 17; 57/264, 265

[56] References Cited

U.S. PATENT DOCUMENTS

| | | | |
|---|---|---|---|
| 3,648,027 | 3/1972 | Ganong et al. | 377/16 |
| 3,660,972 | 5/1972 | Neill et al. | 57/265 |
| 3,952,944 | 4/1976 | Koyanagi et al. | 377/16 |
| 4,167,004 | 9/1979 | Schenck et al. | 377/16 |
| 4,292,800 | 10/1981 | Werst | 57/265 |
| 4,374,361 | 2/1983 | Holden | 377/16 |

*Primary Examiner*—John S. Heyman

*Attorney, Agent, or Firm*—Werner W. Kleeman

[57] ABSTRACT

The electronic scanner serves to monitor a multitude of thread running locations in a textile machine in which a measuring head for detecting a thread rupture or breakage, a bistable controller and switching means are arranged at each thread running location. A clock pulse generator acts upon the clock pulse inputs of the bistable controllers which are series connected and which interrogate or scan the measuring heads via the switching means in a cyclical sequence. The signals obtained from the measuring heads during interrogation or scanning are delivered to a counting circuit via a signal line and a clock-pulse controlled gate. The counting circuit indicates the thread running location associated with a thread rupture.

5 Claims, 7 Drawing Figures

ELECTRONIC SCANNER FOR MONITORING RUNNING THREADS AT A MULTITUDE OF LOCATIONS IN A TEXTILE MACHINE

BACKGROUND OF THE INVENTION

The present invention relates to a new and improved electronic scanner or interrogation system for monitoring a multitude of thread running locations of a textile machine, wherein a measuring head for detecting a thread rupture or breakage is provided at each thread running location.

An electronic scanner as known, for example, from Swiss Pat. No. 601,093, granted Dec. 31, 1977, and German Pat. No. 2,731,019, published Nov. 9, 1978, for monitoring a running sequence of work or operating locations for thread ruptures in a textile machine such as, for example, a ring spinning frame comprises a scanning head which is guided past the work or operative locations for the contactless pick-up of electrical signals which are generated as long as the thread is properly running and which fail to occur when the thread is absent. With these arrangements the scanning head is guided past the work or operative locations along a guide rail by means of a traction band.

It is further known, for example, from German Pat. No. 2,315,328, published April 13, 1978, to monitor in a spinning machine the threads which extend from a multiple number of spinning nozzles for faults which are detected by capacitive scanning heads. The fault indicating signals are stored for a time interval. The scanning heads and the individual stores or storages are periodically scanned or interrogated, and the fault-indicating signals which occur during the scanning intermissions or pauses and which exceed a threshold value remain stored until the following scanning period.

SUMMARY OF THE INVENTION

Therefore, with the foregoing in mind, it is a primary object of the present invention to provide a new and improved construction of an electronic scanner for monitoring a multitude of thread running locations in a textile machine which is free of mechanical devices.

Another important object of the present invention is directed to the provision of a new and improved electronic scanner for monitoring a multitude of thread running locations in a textile machine which is free of any scanning head guided past the measuring locations.

Still a further significant object of the present invention is directed to a new and improved construction of an electronic scanner for monitoring a multitude of thread running locations in a textile machine, which does not require intermittent storage of fault-indicating signals, in this case signals indicating thread rupture or breakage.

Now in order to implement these and still further objects of the invention, which will become more readily apparent as the description proceeds, the apparatus of the present development is manifested by the features that, a series of measuring heads is provided, each for a respective one of the thread running locations, and a series of bistable controllers or control means is provided, each associated with a respective one of said measuring heads. Each bistable controller comprises a data input, a clock pulse input and an output, and the bistable controllers are series connected by means of their data inputs. A clock pulse generator acts upon the clock pulse inputs of the bistable controllers.

Switching means are provided, each of which is operatively associated with a respective one of the bistable controllers and measuring heads. Each switching means comprises a first input connected to a respective one of the measuring heads, a second input connected to the output of a respective one of the bistable controllers and an output, and such outputs of the switching means are connected to a common signal line. A first AND-gate or circuit has a negated first input connected to the signal line and a second input connected to the clock pulse generator. Switching members or elements serve to generate a cyclical series of initiating or start pulses at the data input of a first one of the series connected bistable controllers, such that the output of the first AND-gate is connected via a signalling line to an operative or work device responsive to a thread rupture.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
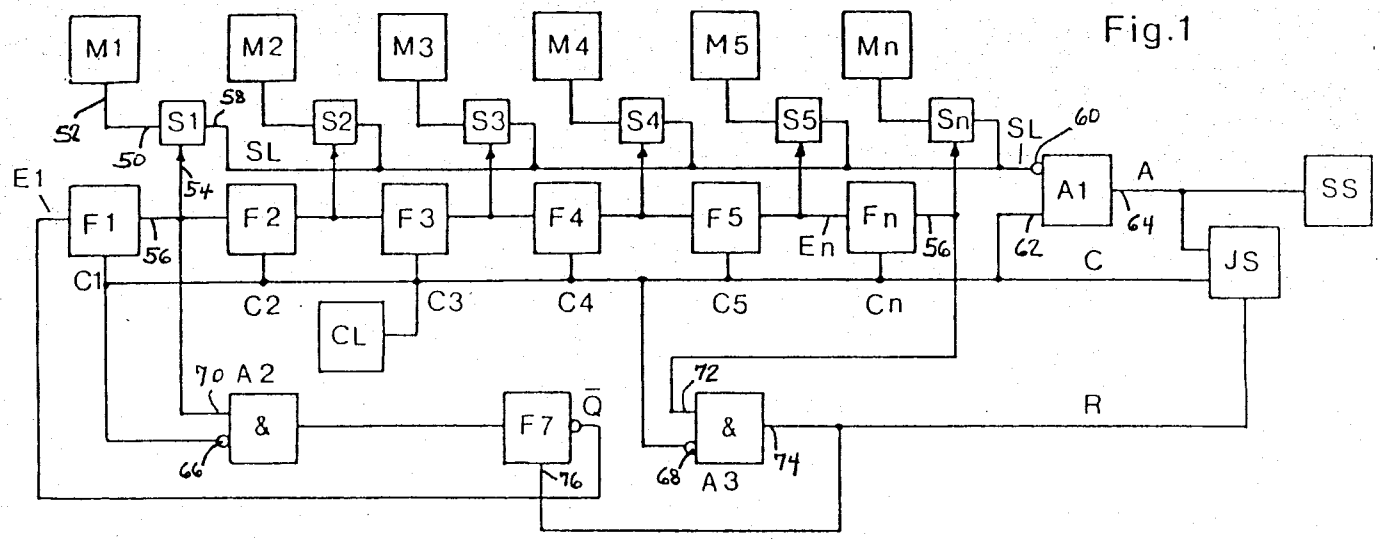
FIG. 1 shows a block circuit diagram of the electronic scanner according to the invention, for instance, for six thread running locations.
Figure 5:
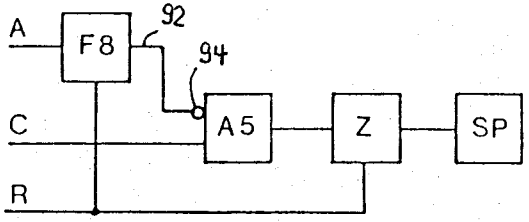
FIG. 5 is a block circuit diagram of a signalling or indicator stage serving to indicate the thread running location at which a thread rupture has occurred, and used in the electronic scanner shown in FIG. 1.
Figure 3:
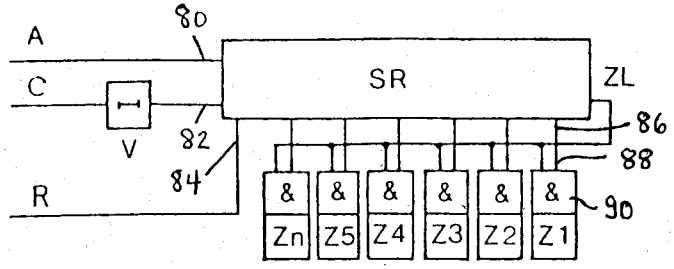
FIG. 3 is a block circuit diagram of a counting stage for individually counting thread ruptures or breakages occurring at the individual thread running locations in the electronic scanner shown in FIG. 1.

Describing now the drawings, it is to be understood that only enough of the details of the circuitry of the electronic scanner has been shown as needed for those skilled in the art to readily understand the underlying principles and concepts of the present development, while simplifying the showing of the drawings. By means of the circuit arrangements or configurations described hereinafter and as shown in FIGS. 1, 3 and 5 a large number of several hundred thread running locations can be effectively monitored. For simplicity only the number of thread running locations in the Figures has been assumed to be $n=6$.

In accordance with FIG. 1, a respective measuring head M1–Mn is arranged at each thread running location of, for example, a ring spinning frame or a flyer. Each measuring head M1 to Mn supplies an analog thread running or travel signal as long as the thread travelling or running runs at the respective thread running location. The thread running signal, then, has a positive value of, for example, up to +5 Volts and is equal to zero in the presence of a thread rupture or thread stoppage or standstill. By performing a limiting operation the thread running signal is transformed into a binary signal having the value of either H or L.

Figure 6:
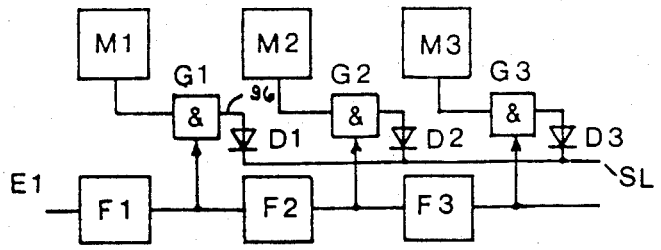
FIGS. 6 and 7 each are respective block circuit diagrams of different embodiments of the switching means incorporated in the electronic scanner shown in FIG. 1.
Figure 7:
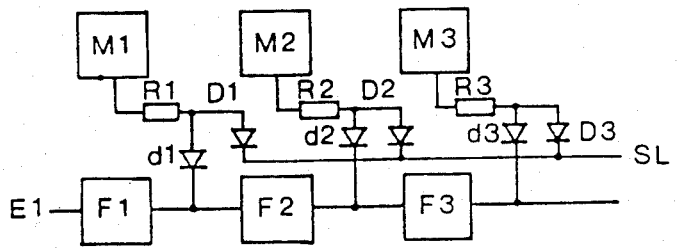

Connected in parallel to the measuring heads M1–Mn is a series connection or circuit of n-bistable controllers F1 to Fn, of which is operatively associated with a respective one of the measuring heads M1 to Mn. Furthermore, switching means S1 to Sn like, for example, electronic switches, are arranged in circuit with the measuring heads M1 to Mn and the bistable controllers F1 to Fn. Each of the switching means S1 to Sn, such as the switching means S1, have a first input 50 connected to the output 52 of a respective measuring head M1 to Mn, here the measuring head M1, and a second input 54 connected to the output 56 of a respective bistable controller F1 to Fn, here the bistable controller F1. The output 58 of each of the switching means S1 to Sn are connected to a common signal line SL. As shown in FIG. 6, the switching means S1 to Sn may also be replaced by AND-gates or circuits G1 to Gn and diodes D1 to Dn. There are also possible still further different arrangements or circuit configurations fulfilling the same function; for example, resistors R1 to Rn and two diodes D1 to Dn and d1 to dn, as shown in FIG. 7.

For scanning or interrogating the individual measuring heads M1 to Mn a clock pulse generator CL is provided which controls the clock pulse inputs C1 to Cn of the bistable controllers or control means F1 to Fn via a clock pulse line C. Preferably, the clock pulse generator CL supplies pulses at a high repetition frequency in the range of several kHz like, for example, 10 kHz. However, the scanning operation may also be accomplished at a very low frequency like, for example, 10 Hz. It may be accomplished in a frequency range of, for instance, about 5 Hz to 250 Hz.

The final or terminating stage of the scanning circuit is formed by a first AND-gate or circuit A1 including a negated first input 60 and a non-negated second input 62. The negated first input 60 is connected to the signal line SL and the second input 62 is connected to the clock pulse line C. The output line or signalling line extending from the output 64 of the first AND-gate A1 is designated by reference character A.

A second AND-gate or circuit A2 including a negated first input 66 and a further bistable controller F7 having a negated output $\overline{Q}$ connected in series thereto form an initiating or start circuit. Furthermore, a third AND-gate or circuit A3 including a negated first input 68 is provided for reset purposes.

The negated first inputs 66 and 68 of the second and third AND-gates A2 and A3, respectively, are connected to the clock pulse line C. The respective second inputs 70 and 72 of the AND-gates A2 and A3 are connected to the respective output 56 of the first and the last in the series of bistable controllers F1 and Fn, respectively. The negated output Q of the further bistable controller or control means F7 controls the data input E1 of the bistable controller F1 which is the first in the series. The output 74 of the third AND-gate A3 is connected to the reset input 76 of the further bistable controller F7. The output line extending from the output 74 of the third AND-gate A3 is designated by reference character R.

An operative device containing a switching stage SS which, in the case of thread rupture turns-off either the textile machine or just the related thread running location, is connected to the signalling or indicator line A. The operative device further includes an indicating or indicator stage JS as will be described with reference to FIGS. 3 and 4 of the drawings in greater detail hereinafter; the indicating stage JS is connected to the signalling line A, to the clock pulse line C and to the line R connected to the output 74 of the third AND-gate A3.

The mode of operation of the electronic scanner or interrogation system described heretofore will now be explained with reference to FIG. 2.

Figure 2:
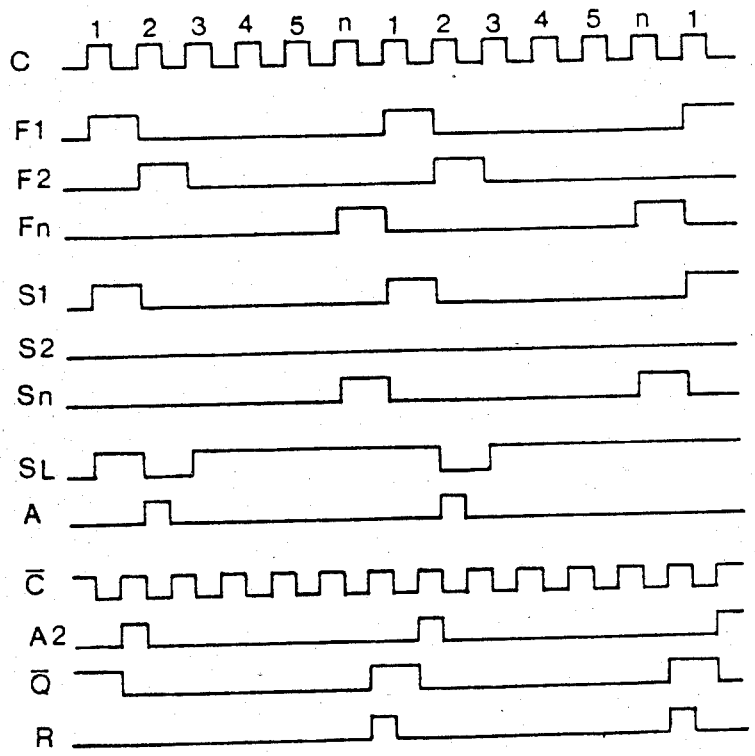
FIG. 2 is a schematic representation of the signals or pulses occurring at different locations of the electronic scanner shown in FIG. 1.

In FIG. 2 the lines C and $\overline{C}$ indicate the sequence of clock pulses and negated clock pulses, respectively; F1 to Fn indicate the output signals of the bistable controllers F1 to Fn; the other or remaining output signals are designated by the same designation as the circuit members which generate the same or by the same designation as the designation of the lines or conductors operatively associated therewith.

All of the logic circuit elements illustrated in FIG. 1 as well as the clock pulse generator CL have binary signals H or L at their respective outputs. In the beginning all bistable controllers F1 to Fn are in their rest or stable state, i.e., in a state in which the output signal is L. Then, the output signal $\overline{Q}$ of the further bistable controller F7 is H.

The first bistable controller or control means F1 is set by an initiating or start pulse $\overline{Q}$ equal to H and the first clock pulse $\overline{C}$; it is reset by the second clock pulse. Consequently, the bistable controllers F2 and so forth to Fn following in the series circuit are consecutively set during the respective time period of the clock pulse $\overline{C}$ and are again reset.

It will be assumed that the measuring heads M1, M3 to Mn generate a thread running signal having a positive value while, due to thread rupture, the measuring head M2 delivers a signal having the value null. FIG. 2 shows only the signals F1, F2, Fn as well as S1, S2 and Sn. All the F-signals are shifted from one another by just one clock pulse; as to the S-signals, the signal S2 is absent while all of the remaining S-signals occur at the same as the corresponding F-signals.

To the signal line SL there is now applied the sum of all S-signals, i.e. the sum or summation signal is of the H-type for the duration of all S-signals with the exception of the signal S2. For the duration of the signal S2 the sum signal on the signal line SL has the value L. Logic addition of the negated sum signal SL and the clock pulse at the first AND-gate A1 results in an output signal A which appears on the signalling line A. This output signal A has the value L when the measuring heads M1, M3 to Mn with the respective thread running in order are scanned or interrogated, however, assumes the value H when the measuring head M2 with the defective thread is scanned or interrogated.

The last four lines in FIG. 2 relate to the pulses generated by the initiating or start circuit A2, F7 formed by the second AND-gate A2 and the further bistable controller F7, and by the reset circuit A2 formed by the third AND-gate A3. Here there is also illustrated the sequence $\overline{C}$ of the inverted clock pulses which are decisive for the clock pulse control of the aforementioned circuits.

The output signal A appearing on the signalling line A is processed in different ways in the operative device including the stages or circuits SS and JS shown in FIG. 1. Thus, the output signal A may serve in known manner to turn-off the textile machine or the thread running location at which thread rupture or breakage has occurred by means of the switching stage SS. The indicating or indicator stage JS for indicating or, respectively, counting thread ruptures will now be explained with reference to FIGS. 3 and 5.

In the first embodiment of the indicating or indicator stage JS as shown in FIG. 3 there is incorporated a counting stage which registers the thread ruptures occurring at the individual at measuring heads M1 to Mn in separate counters Z1 to Zn. Such an indicating stage JS can be utilized to advantage at a ring spinning frame.

This counting stage includes an n-place shift register SR which has a data input 80 connected to the signalling line A and a shift input 82 connected to the clock pulse line C via an interconnected time-delay element E. The shift register SR has a reset input 84 which is connected to the reset line R.

The outputs 86 of the individual elements or cells in the shift register SR are each connected via the related first input 88 of a respective AND-gate 90 to a respective counter Z1 to Zn. A second input 92 of each of the AND-gates 90 is connected to a counting line ZL on which a counting pulse appears at the end of each scanning or interrogation cycle. By means of the counting pulse the H-signal stored in the element or cell associated with the measuring head at which a thread rupture has been detected is supplied to the associated counter which, in the present case, is the counter Z2. At the end of each scanning or interrogation cycle the shift register SR is reset by a reset pulse appearing on the reset line R. The sequence of the counters Z1 to Zn is from the rear to the front due to the fact that the signal associated with the first measuring head M1 and appearing on the signalling line A appears in the rearmost element or cell of the shift register SR at the time of the counting pulse ZL.

To prevent a thread rupture from being counted a number of times the associated thread running location will have to be inactivated by the switching stage SS shown in FIG. 1 when an H-signal appears on the signalling line A. Furthermore, the counting process will have to be interrupted, for example, by interrupting the circuit by using a suitable switching element (not shown) connected in the clock pulse line $\overline{C}$. After removal of the thread rupture the thread running location and the counting process are manually re-started.

Figure 4:
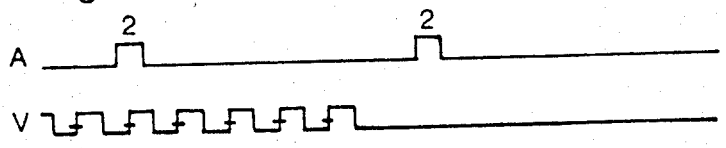
FIG. 4 is a schematic representation of the signals or pulses occurring in the counting stage shown in FIG. 3.

In the first line of FIG. 4 the signal appearing on the signalling line A, as shown in FIG. 1, is shown again and, in the second line thereof, there is illustrated the delayed clock pulse V.

By the leading edge of the delayed clock pulse V, marked by a short transversely extending line, the value of the signal simultaneously appearing on the signalling line A is fed into the shift register SR; in the present case this is the value H of the signal appearing on the signalling line A, which appears simultaneously with the second clock pulse.

FIG. 5 shows a second embodiment of the indicating or indicator stage JS which is a simple circuit for indicating the thread running location at which a thread rupture or breakage has occurred. As long as the signal appearing on the signalling line A is an L-signal, i.e., as long as no thread rupture is present, the bistable controller F8 is in a rest state, i.e. an L-signal appears at the output 92 thereof. In this case, the clock pulses appearing on the clock pulse line $\overline{C}$ pass through an AND-gate A5 via the negated input 94 thereof. The clock pulses are counted into the counter Z in the form of numbers 1 to n during each scanning or interrogation cycle. The bistable controller F8 is set by a H-signal appearing on the signalling line A which appears in the case of thread rupture. Consequently, the AND-gate A5 is blocked for the passage of clock pulses, the counter Z stops and indicates the number of the thread running location at which the thread rupture or breakage has occurred. The number is stored in a storage element SP; this number may be manually erased therefrom by actuating a suitable key or the like (not shown).

The indicating circuit as described hereinbefore is advantageously used for the indication of sliver or slubbing ruptures or the like in a flyer.

FIG. 6 shows a further possible design of circuitry which may replace the switching means S1 to Sn. The switching means S1 to Sn are substituted each by an AND-gate G1 to Gn, respectively, and a diode D1 to Dn, respectively. In such a circuit configuration an H-signal will appear at the output 96 of the relevant AND-gate when a related measuring head M1 to M3 and the associated bistable controller F1 to F3 each supply an H-signal to the related AND-gate G1 to G3, respectively. The H-signal is, then, fed to the signal line SL via the associated diode D1 to D3. Thus, the same function is realized as with the switching means S1 to Sn shown in FIG. 1. The diodes D1 to Dn serve for decoupling purposes.

A different circuit design for replacing the switching means S1 to Sn is shown in FIG. 7. Accordingly, each of the switching means S1 to Sn is here replaced by a resistor R1 to Rn, respectively, and two diodes D1 to Dn, respectively, and d1 to dn, respectively. As long as all measuring heads M1 to Mn supply an H-signal, which is the case if the running or travelling thread is intact order, an H-signal will appear on the signal line SL when the measuring heads M1 to Mn are scanned or interrogated by the respectively associated bistable controllers F1 to Fn. In the case of thread rupture, for example, at the measuring head M2, such will instead supply an L-signal which appears on the signal line SL when the measuring head M2 is scanned or interrogated by the bistable controller F2. The effect or function thus is the same as the function of the switching means S1 to Sn shown in FIG. 1 and as illustrated in FIG. 2.

While there are shown and described present preferred embodiments of the invention, it is to be distinctly understood that the invention is not limited thereto, but may be otherwise variously embodied and practiced within the scope of the following claims. Accordingly,

What I claim is:

1. An electronic scanner for monitoring a multitude of thread running locations in a textile machine, comprising:

a respective measuring head provided for each respective one of the thread running locations and serving to detect thread rupture or standstill thereat;

a series of bistable controllers, each associated with a respective one of said measuring heads;

a clock pulse generator;

each of said bistable controllers containing a data input, a clock pulse input and an output;

said bistable controllers being connected in series with one another by means of said data inputs;

said clock pulse generator acting upon said clock pulse inputs of said bistable controllers;

a plurality of switching means each containing a first input, a second input and an output;

said first input of each switching means being connected to a related one of said measuring heads and said second input being connected to the output of a related one of said bistable controllers;

a common signal line connected to said outputs of said switching means;

a first AND-gate having a negated first input, a second input and an output;

said negated first input of said first AND-gate being connected to said signal line and said second input thereof being connected to said clock pulse generator;

a signalling line;

an operative device responsive to thread rupture;

switching members for generating a cyclic series of initiating pulses at said data input of a first one of said series of said bistable controllers;

whereby said output of said first AND-gate is connected to said operative device via said signalling line.

2. The electronic scanner as defined in claim 1, wherein:

said clock pulse generator operates at a pulse frequency in the range of 5 Hz to 250 Hz.

3. The electronic scanner as defined in claim 1, wherein said switching members comprise:

a second AND-gate including a negated first input, a second input and an output;

said negated first input of said second AND-gate being connected to said clock pulse generator and said second input thereof being connected to said output of said first one of said series of said bistable controllers;

a further bistable controller having a first input, a reset input and a negated output;

said first input of said further bistable controller being connected to said output of said second AND-gate and said negated output of said further bistable controller being connected to said data input of said first one of said series of said bistable controllers;

a third AND-gate having a negated first input, a second input and an output; and said negated first input of said third AND-gate being connected to said clock pulse generator, said second input thereof being connected to said output of a last one in said series of said bistable controllers, and said output of said third AND-gate being connected to said reset input of said further bistable controller.

4. The electronic scanner as defined in claim 1, wherein said operative device comprises:

a counting stage including a shift register having a series of parallel outputs; and a series of counters each connected to a respective one of said outputs of said counting stage and each associated with a respective one of said measuring heads.

5. The electronic scanner as defined in claim 1, wherein said operative device comprises:

an indicating stage including a counter;

said counter containing therein a number of counting places;

said number of counting places corresponding to the number of said measuring heads; and said counter indicating that one of said measuring heads at which thread rupture has occurred by interruption of the counting operation.

* * * * *